US012780462B1

(12) United States Patent
Lin et al.

(10) Patent No.: US 12,780,462 B1
(45) Date of Patent: Nov. 3, 2026

(54) WATER BALLOON AND QUICK-RELEASE SYSTEM THEREFOR

(71) Applicant: Stallion Sport Limited, Kowloon (HK)

(72) Inventors: Joseph Lin, Carson, CA (US); Wai Tung Chau, Tuen Mun (HK); Chun Kit Simon Chan, Tsing Yi (HK)

(73) Assignee: Stallion Sport Limited, Kowloon (HK)

( * ) Notice: Subject to any disclaimer, the term of this patent is extended or adjusted under 35 U.S.C. 154(b) by 0 days.

(21) Appl. No.: 19/241,056

(22) Filed: Jun. 17, 2025

(51) Int. Cl.
*A63H 27/10* (2006.01)
*B65B 3/10* (2006.01)

(52) U.S. Cl.
CPC ..... *B65B 3/10* (2013.01); *A63H 27/10* (2013.01)

(58) Field of Classification Search
CPC ..... B65B 3/10; A63H 27/10; A63H 33/18
USPC ..... 141/114
See application file for complete search history.

(56) References Cited

U.S. PATENT DOCUMENTS

2010/0072750 A1* 3/2010 Nance ..... A63H 27/10 289/1.5
2024/0102769 A1* 3/2024 Ganor ..... A63H 27/10

FOREIGN PATENT DOCUMENTS

CN 116920430 A * 10/2023 ..... A63H 33/18

OTHER PUBLICATIONS

CN 116920430 A—English Translation (Year: 2024).*

* cited by examiner

*Primary Examiner* — Christopher M Afful
(74) *Attorney, Agent, or Firm* — Raymond Sun

(57) ABSTRACT

A water balloon system has a filling assembly having a film body that has a water distribution channel extending through the film body, a main inlet provided at one end thereof and communicating with the water distribution channel, and a plurality of water balloons connected along the film body, each water balloon having an interior that communicates with the water distribution channel through an inlet port, and having a one-way valve positioned at the inlet port. A tear line is provided between each water balloon and the film body. The system also has a connector assembly having a nozzle extending from a threaded nozzle opening, and a quick-release slot provided adjacent the threaded nozzle opening. The water balloons are filled with water via the main inlet, the water distribution channel, and the inlet port of each water balloon. The film body and attached water balloons are then inserted and pulled through the quick-release slot to separate the water balloons from the film body.

6 Claims, 2 Drawing Sheets

WATER BALLOON AND QUICK-RELEASE SYSTEM THEREFOR

BACKGROUND OF THE INVENTION

1. Field of the Invention

The present invention relates to water play devices, and more particularly, to an improved thin-film water balloon system with an integrated quick-release mechanism for rapid and efficient deployment.

2. Description of the Prior Art

The film-filled water balloons currently on the market offer an innovative and environmentally-friendly alternative to traditional water balloons. The product is simple to use: the water balloon is attached to the film and can be filled by laying the film flat and connecting a garden hose to the included reusable nozzle. Once filled, the water balloon automatically seals and detaches from the film, and is ready for play. Cleanup is also very convenient because the water balloon remains intact after popping, eliminating the hassle of collecting scattered balloon fragments. Although it provides an innovative and environmentally friendly alternative, there are still some obvious disadvantages in the user experience.

First, although the water balloons are pre-attached to the film for easy filling, they do not automatically seal and detach from the film after filling. This means that users need to manually remove the water balloons one by one, which increases the complexity and time cost of the operation and is not convenient enough. When conducting large-scale water battles, users need to spend more time preparing, which limits the fluency and fun of the game.

Second, existing products suggest that users lay the film completely flat to achieve the ideal water balloon filling effect, but this method is actually not very convenient and limits the time to speed up the filling. Users may lift the water tube during filling, resulting in failure to fill the water balloon. At the same time, when replacing the film after filling is completed, it reduces the user experience and time.

In summary, although there are many film-filled water balloons on the market, there is still a need for rapid and large-scale removal of water balloons to enhance user convenience and gaming experience.

SUMMARY OF THE DISCLOSURE

To achieve the objectives of the present invention, the present invention provides a system and method for providing a plurality of detached and filled water balloons. A water balloon system has a filling assembly having a film body that has a first end and a second end, with a water distribution channel extending through the film body, a main inlet provided at the first end and communicating with the water distribution channel, the filling assembly further including a plurality of water balloons connected along the film body, with each water balloon having an interior that communicates with the water distribution channel through an inlet port, and having a one-way valve positioned at the inlet port, and wherein a tear line is provided between each water balloon and the film body. The system also has a connector assembly having a nozzle extending from a threaded nozzle opening, and a quick-release slot provided adjacent the threaded nozzle opening. A water hose is attached to the main inlet, and water from a water source enters the main inlet via the water hose and flows through the water distribution channel and into the inlet port of each water balloon to fill each water balloon. The film body and attached water balloons are then inserted and pulled through the quick-release slot to separate the water balloons from the film body.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
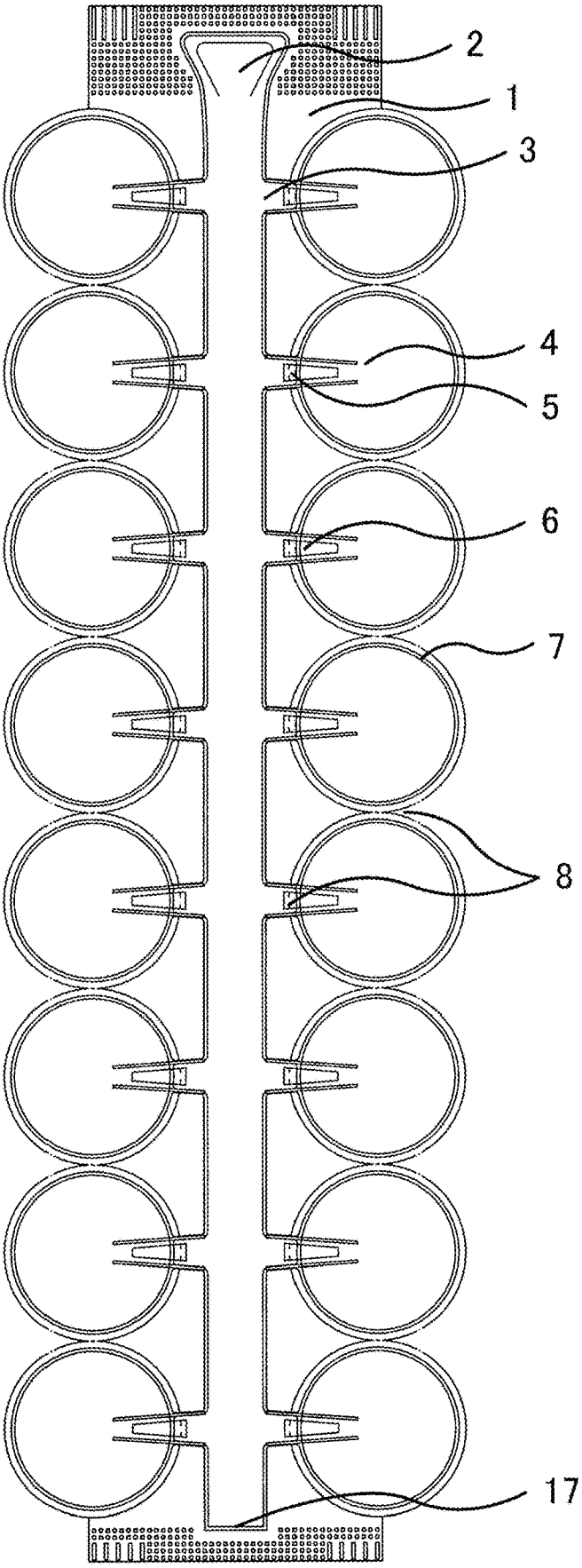
FIG. 1 is a top schematic view of a water balloon filling and release system according to the present invention.
Figure 2:
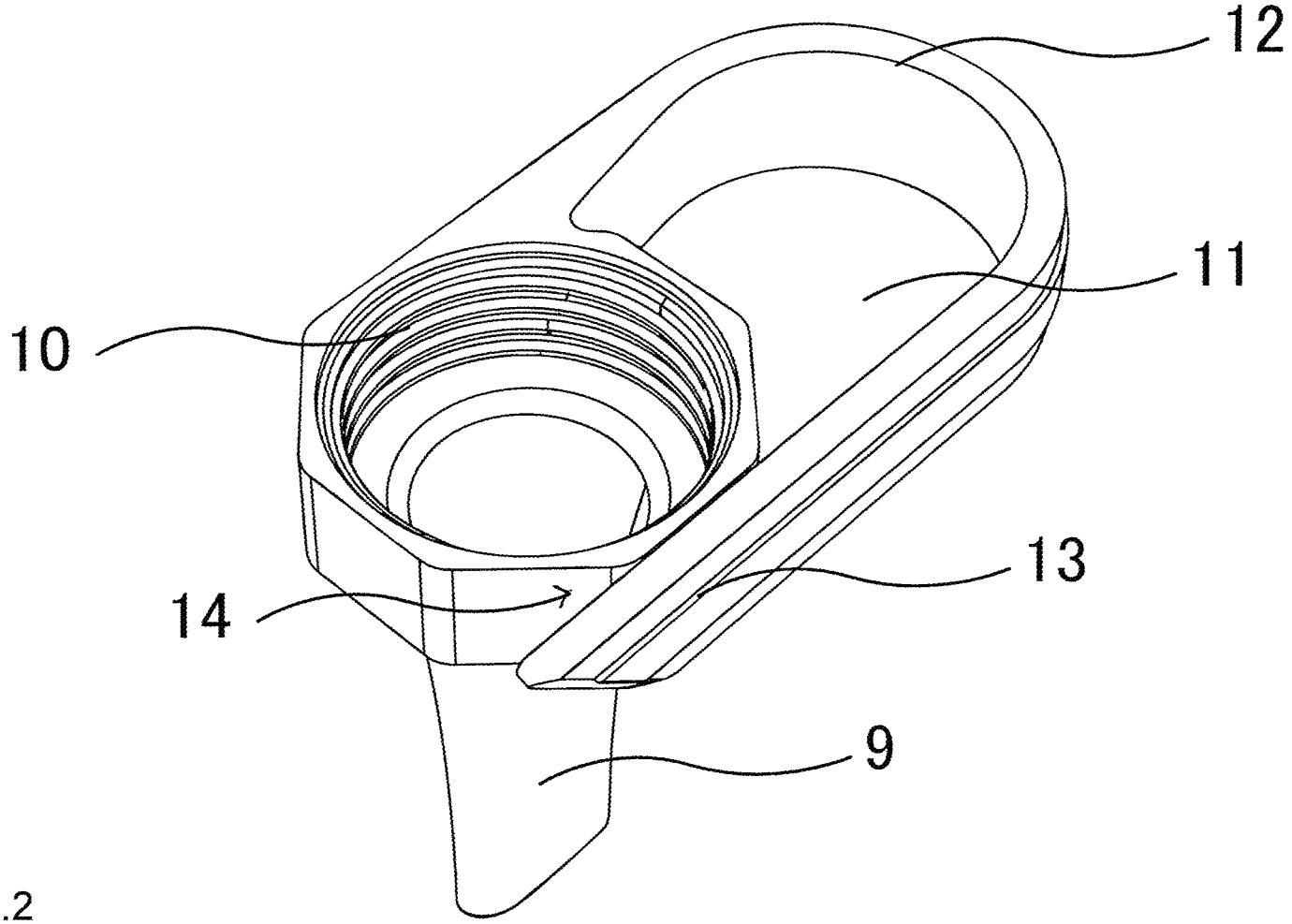
FIG. 2 is a perspective view of the connector assembly for the system of FIG. 1.

FIGS. 1 and 2 illustrate a water balloon filling and release system according to the present invention. The system is provided in two separate components: a filling assembly with water balloons connected thereto (FIG. 1), and a connector assembly (FIG. 2).

The filling assembly has a film body 1 that is a flat and flexible sheet made from biodegradable or recyclable material that extends along the entire tube. A main inlet 2 is provided at a first end of the film body 1 and functions as a connection port that can be attached to a standard water hose. A water distribution channel 3 extends along the length of the film body 1 from the first end to a sealed second end 17, and is essentially an internal tube that connects the main inlet 2 to a plurality of water balloons 4. In particular, a series of water balloons 4 are provided in spaced-apart manner along each side of the channel 3. Each water balloon 4 is connected to the channel 3 by an inlet port 5 that allows water from the channel 3 to enter and fill the water balloon 4. A one-way valve 6 is embedded in each inlet port 5 to provide a self-sealing function after the water balloon 4 has been filled with water.

The inner wall of each water balloon 4 has heat seal lines 7 that are essentially thermally bonded seams that are used to shape the balloon and to ensure structural integrity. Predefined tear lines 8 in the form of engineered micro-perforations are provided between adjacent water balloons 4 and between each water balloon 4 and the film body 1 for clean and rapid separation.

The connector assembly has a housing that defines a nozzle opening 10, which is a threaded region that allows common hose sizes to be threadably attached thereto. A nozzle 9 extends from the bottom of the nozzle opening 10. The nozzle 9 is a rigid connection piece that is adapted to be inserted into the main inlet 2. A quick-release slot 11 is defined by a hooked piece 12 that extends from one side of the nozzle opening 10 to the other side of the nozzle opening 10, with the free end 13 of the hooked piece 12 defining a slit 14. This quick-release slot 11 allows for the fast threading of the film body 1 to separate the water balloons 4 after the water balloons have been filled.

The system is designed to be used near a water source. The user removes the film body 1 from its packaging, ensuring that all attached water balloon units 4 remain intact and undamaged. The structure of the film body 1 is based on a film substrate that integrates multiple technical components. The film body 1 is made of a biodegradable material with sufficient toughness and flexibility to maintain structural integrity during water-filling and to burst under pressure to achieve its intended function.

The user connects the threaded nozzle opening 10 to a standard household water source and inserts the nozzle 9 into the main inlet 2. When the water source is activated, water flows through the nozzle 9 into the film body 1, evenly filling the multiple water balloon units 4. Throughout the process, the film body 1 remains stable, ensuring uniform filling of all water balloon units 4.

As each water balloon 4 becomes fully filled, the built-in one-way valve 6 at the respective inlet port 5 automatically seals, preventing any leakage and enhancing ease of use. Each water balloon unit 4 is independently affixed to the film structure of the film body 1 in an organized layout, supporting consistent filling and detachment.

After filling, the user inserts the main inlet 2 of the film body 1 through the quick-release device on the connector assembly. Specifically, the main inlet 2 can be inserted through the slit 14 and into the quick-release slot 11. This mechanism allows the entire sheet (i.e., the film body 1) to slide through the slot 11, enabling rapid and clean separation of individual water balloons 4. The entire film body 1 is pulled through the slot 11, sequentially detaching each water balloon 4 along the tear lines (perforations) 8. The separation is facilitated by the engineered tear lines 8 along the film body 1, which allow each water balloon 4 to detach without damaging the overall film body 1. This controlled separation along the tear lines 8 ensures the water balloons 4 can be quickly and individually removed and immediately used for play while avoiding damage to the film body 1.

This design effectively reduces the complexity of the traditional water balloon that needs to be manually disassembled after filling with water. The user does not need to manually disassemble each water balloon 4 one by one, thereby reducing the operation time and cost and improving convenience.

During use, the detached water balloons 4 can be employed in water fights, tossing games, and various outdoor activities. The water balloons 4 feature heat-sealed seams (seal lines 7) that keep them intact during preparation and enable a predictable burst pattern once force is applied, thereby enhancing the fun and safety of gameplay.

After the activity, users do not need to worry about scattered balloon fragments. The design ensures that each water balloon 4 maintains its integrity even after bursting, requiring only minimal cleanup. Through these features, the present invention significantly improves the user experience in water balloon filling, mass preparation, and rapid deployment, making it ideal for repeated water play activities and offering a highly practical and innovative solution.

The present invention addresses the shortcomings in user experience associated with existing thin-film water balloon systems on the market. The system is simple to use and features a quick-release mechanism that eliminates the need for manual detachment of each water balloon, which is common in traditional products, thereby significantly reducing preparation time and operational complexity while enhancing user convenience.

Furthermore, this technical solution improves upon the conventional water distribution method. Prior systems require the user to lay the film flat for optimal water flow, which in practice is inconvenient and limits the speed and flexibility of the filling process. Users often raise or move the hose during filling, leading to uneven or failed water balloon fills, adding to user frustration. Additionally, replacing the film after one round of filling under such prior designs further detracts from the overall user experience and efficiency. The present invention addresses this drawback by providing a funnel-shaped water inlet spout (i.e., the nozzle 9) that allows for more flexible user operation. Users can position the film body 1 in various ways without compromising the water flow or filling results. This overall system design enhances the convenience of the filling process and reduces the likelihood of operational error, thereby ensuring a more reliable and enjoyable experience.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A water balloon system, comprising:

a filling assembly having a film body that has a first end and a second end, with a water distribution channel extending through the film body, a main inlet provided at the first end and communicating with the water distribution channel, the filling assembly further including a plurality of water balloons connected along the film body, with each of the plurality of water balloons having an interior that communicates with the water distribution channel through an inlet port, and having a one-way valve positioned at the inlet port, wherein a tear line is provided between each of the plurality of water balloons and the film body; and a connector assembly having a threaded nozzle opening, with a nozzle extending from the threaded nozzle opening, and a quick-release slot provided adjacent the threaded nozzle opening.

2. The system of claim 1, wherein each of the plurality of water balloons is connected to an adjacent one of the plurality of water balloons by a connection that includes another tear line.

3. The system of claim 1, wherein a hooked piece extends from one side of the threaded nozzle opening to another side of the threaded nozzle opening, and the hooked piece has a free end defining a slit between the hooked piece and the threaded nozzle opening.

4. The system of claim 1, wherein the film body is inserted through the quick-release slot and pulled through the quick-release slot to separate the plurality of water balloons from the film body.

5. A method for providing a plurality of detached and filled water balloons, comprising:

providing a water balloon system comprising:

a filling assembly having a film body that has a first end and a second end, with a water distribution channel extending through the film body, a main inlet provided at the first end and communicating with the water distribution channel, the filling assembly further including a plurality of water balloons connected along the film body, with each of the plurality of water balloons having an interior that communicates with the water distribution channel through an inlet port, and having a one-way valve positioned at the inlet port, wherein a tear line is provided between each of the plurality of water balloons and the film body; and a connector assembly having a threaded nozzle opening, with a nozzle extending from the threaded nozzle opening, and a quick-release slot provided adjacent the threaded nozzle opening;

attaching a water hose to the main inlet;

causing water from a water source to enter the main inlet via the water hose and flow through the water distribution channel and into the inlet port of each of the plurality of water balloons; and inserting and pulling the film body and attached water balloons through the quick-release slot to separate the plurality of water balloons from the film body.

6. The method of claim 5, wherein a hooked piece extends from one side of the threaded nozzle opening to another side of the threaded nozzle opening, and the hooked piece has a free end defining a slit between the hooked piece and the threaded nozzle opening, and wherein the step of inserting and pulling includes inserting the film body through the slit.

* * * * *